United States Patent [19]

Myers

[11] Patent Number: 4,470,030

[45] Date of Patent: Sep. 4, 1984

[54] TRIP SOLENOID

[75] Inventor: John L. Myers, Tipp City, Ohio

[73] Assignee: Ledex, Inc., Vandalia, Ohio

[21] Appl. No.: 495,891

[22] Filed: May 18, 1983

[51] Int. Cl.[3] ..... H01F 7/08

[52] U.S. Cl. ..... 335/228; 335/230; 335/234

[58] Field of Search ..... 335/228, 229, 230, 234, 335/272

[56] References Cited

U.S. PATENT DOCUMENTS

| | | | |
|---|---|---|---|
| 2,496,880 | 2/1950 | Leland . | |
| 2,566,571 | 9/1951 | Leland . | |
| 2,915,681 | 12/1959 | Troy | 335/229 X |
| 3,027,772 | 4/1962 | Smith . | |
| 3,755,766 | 8/1973 | Read | 335/234 X |
| 3,783,423 | 1/1974 | Mater et al. | 335/174 |
| 3,792,390 | 2/1974 | Boyd | 335/229 |
| 4,316,167 | 2/1982 | Koehler | 335/234 |

OTHER PUBLICATIONS

Publication Catalog LS-1017, Ledex, Inc. (Dec. 1982) "Linear Solenoids".

*Primary Examiner*—George Harris
*Attorney, Agent, or Firm*—Biebel, French & Nauman

[57] ABSTRACT

Trip solenoids are disclosed in which a permanent magnet is positioned exteriorly of the armature case. In one version, a rotary solenoid has a permanent magnet between a ball race plate and the case and has a magnetic force sufficient to hold the rotary solenoid in its actuated position when the power is removed from the solenoid coil. An axial version of the trip solenoid is also disclosed.

6 Claims, 5 Drawing Figures

TRIP SOLENOID

BACKGROUND OF THE INVENTION

This invention pertains to magnetic trip solenoids, and more particularly to a cased type rotary or linear solenoid which is magnetically self-holding in an actuated position.

Permanent magnet arrangements have been applied to various open frame type linear type solenoids for the purpose of retaining a solenoid armature or plunger in one of its two positions, normally at the energized position. The permanent magnets hold the armature in such an energized position following the removal of the electric power to the coil. Such trip solenoids are then released by applying a reverse pulse, of limited duration, to the energizing coil to cancel the holding flux, and release the armature for return under the influence of a conventional return spring to the unenergized position. An example of an axial magnetic trip solenoid may be found in my copending application Ser. No. 471,542 filed March 2, 1983.

A highly successful form of solenoid is the cased solenoid. One form of a cased solenoid is a rotary solenoid which employs complementary inclined ball races between relatively moving parts to convert an axial stroke to a rotary stroke, as shown for example in the patents of G. H. Leland, U.S. Pat. No. 2,496,880 of Feb. 7, 1950 and U.S. Pat. No. 2,566,571 of Sept. 4, 1951. In another form, the balls and ball races are omitted, and the solenoid performs only an axial stroke and is known as a linear or push/pull solenoid.

Various arrangements have been employed in which the force/stroke curve of a cased type rotary solenoid may be modified or adjusted, including the arrangements shown in the patent of Smith, U.S. Pat. No. 3,027,772 issued Apr. 3, 1952 in which detents are provided at the deep ends of the ball races for the purpose of permitting a decrease in the current necessary to maintain the solenoid in its energized position. However, the arrangement shown in the Smith patent does not provide a trip solenoid function, since it is necessary to keep some current flowing through the coil to hold the solenoid in the moved position. No permanent magnet arrangement is shown in Smith for holding the solenoid in its energized position.

SUMMARY OF THE INVENTION

This invention is directed to cased rotary and axial solenoids, and more particularly to a solenoid of the type described above which includes a permanent magnet for latching or holding the solenoid armature at its moved or energized position. The permanent magnet may be formed as an annulus, axially polarized, and positioned between the case and a superimposed annular plate. In the rotary embodiment, the ball races are partially formed in the superimposed plate, and the mating halves of the ball races are conventionally formed in the armature plate, with the balls trapped therebetween. The magnetic flux is efficiently directed to the case in a circuit which includes the case, the pole, the armature, and the superimposed ball race plate, as well as the armature plate and the individual balls, where applicable. Pulsing the coil to release the solenoid from its moved position will temporarily cancel a major portion of the flux across the working gaps, but will not result in reversing the magnetic flux through the permanent magnet, thereby protecting the permanent magnet against demagnetization. The magnet arrangement provides a highly compact and yet efficient cased type rotary or linear trip solenoid.

It is accordingly an important object of this invention to provide a cased type trip solenoid.

A further object of the invention is the provision of a cased trip solenoid, as outlined above, in which a permanent magnet is mounted on an outer surface of the case.

A still further object of the invention is the provision of a trip solenoid in which a generally ring-shaped or annular permanent magnet is affixed to the solenoid case, and is magnetically axially oriented to provide a flux path between the armature and the case.

These and other objects and advantages of the invention will be apparent from the following description, the accompanying drawings, and the appended claims.

DESCRIPTION OF PREFERRED EMBODIMENTS

Figure 1:
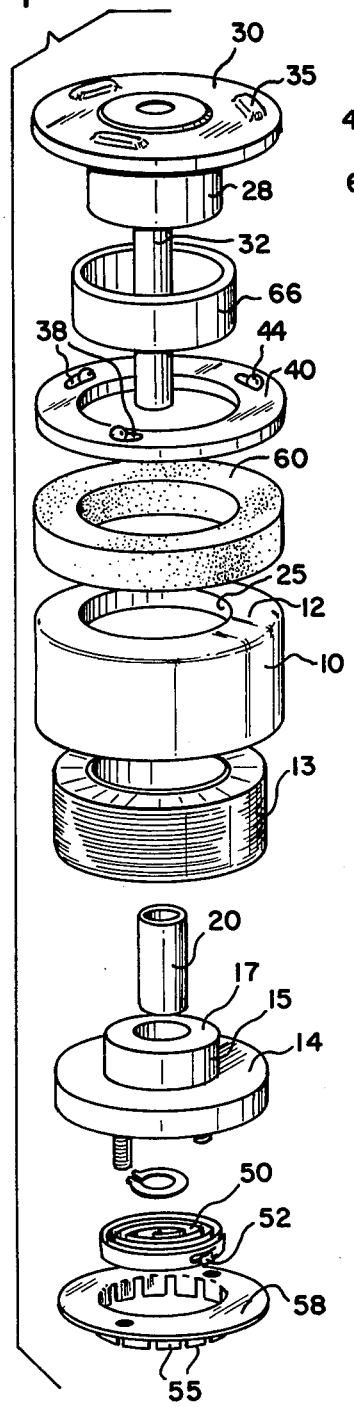
FIG. 1 is an exploded view of a rotary trip solenoid according to this invention.
Figure 2:
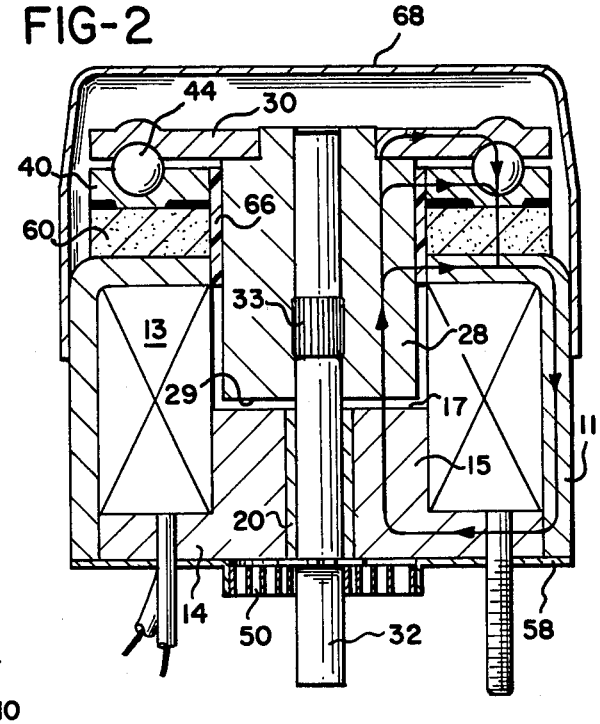
FIG. 2 is a vertical section through the solenoid looking generally along the line 2—2 of FIG. 3.
Figure 3:
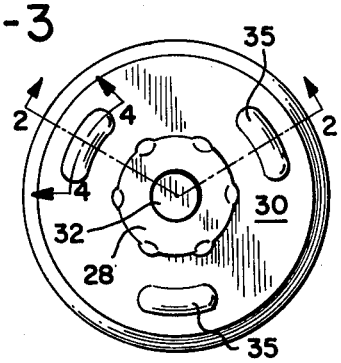
FIG. 3 is a top plan view, on a reduced scale, of the solenoid with the dust cover removed.

Referring to the figures of the drawings which illustrate preferred embodiments of the invention, a cased type rotary solenoid constructed according to this invention is illustrated as including a generally cup-shaped case 10. The case 10 may be considered to be cup-shaped as it has a cylindrical side wall 11 and a flat bottom wall 12. The case 10 is drawn of suitable ferromagnetic material, and receives an annular electrical energizing coil 13. The coil 13, which may be a precision wound self-standing coil as shown, or may be wound on a bobbin, forms a close fit with the case interior against the bottom wall 12 of the case, with an axial depth less than that of the case.

A base 14 also formed of ferromagnetic material is received in the open end of the case 10, and is fixed thereto. The base 14 is provided with a central pole 15 which extends inwardly partially into the coil and terminates at a flat pole face 17. The base is centrally apertured to receive a bearing 20.

The flat bottom wall 12 of the case 10 is provided with a central armature opening 25. An armature 28 extends through this opening and terminates in a pole face 29 spaced from the base pole face 17. A generally cylindrical armature plate 30 is attached to an outer or exterior portion of the armature. The plate 30 is preferably fitted and staked onto a ledge formed on the armature so that it is permanently fixed to the armature. A solenoid shaft 32 extends through the armature and through the bearing 20, and knurling 33 formed on the shaft 32 secures the armature and shaft together.

Figure 4:
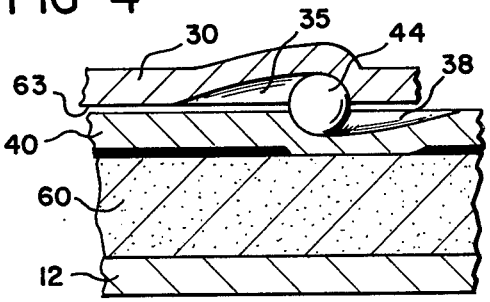
FIG. 4 is an enlarged fragmentary vertical section taken generally along the line 4—4 of FIG. 3.

The plate 30 is provided with three arcuately spaced ball races 35, as shown in enlarged section in FIG. 4, concentric to the axis of the shaft 32. Three identical ball races are formed at 120° intervals, preferably by precision coining, on the inside surface of the plate 30.

Complementary ball races 38 are formed in an annular ball race plate 40, also formed of ferromagnetic material. The plate 40 is received in underlying relation to the plate 30, and bearing balls 44 are captured therebetween in the complementary ball races. As shown in the enlarged fragmentary view in FIG. 4, the ball races are inclined about their arcuate paths so that when the balls reach the respective deep ends, as shown in FIG. 4, the solenoid is at its fully actuated position, and further rotation is mechanically prevented. The armature is returned to its starting position by any suitable return means, in this instance, by a coiled return spring 50 which has its inner turn secured to a flat formed on the shaft 32, and which has its outer end in the form of a tang 52 (FIG. 1) which may be selectively engaged over any one of a plurality of lanced ledges 55 formed on a spring retainer disc 58. The retainer disc 58 is suitably secured against the flush outside surface of the base 14 and case 10.

Holding magnet means in the form of a permanent magnet 60 is positioned between the ball race plate 40 and the exterior flat surface of the case wall 12. The permanent magnet 60 as shown in the drawings is an annulus, but it is within the scope of this invention to use indvidual magnets, such as a pair of arcuately shaped or semi-circular magnets, or a plurality of individual smaller magnets arranged in a circle, between the plate 40 and the case 10. The magnet or magnets 60 are thickness oriented in that the opposite poles are formed on the opposite axially spaced planar surfaces. Preferably, the magnet 60 has an outer diameter which is substantially the same as the outer diameters of the armature plate 30 and the ball race plate 40, to provide a compact arrangement.

The lower surface of the magnet 60 is bonded by adhesive to the case and the upper surface thereof is bonded by adhesive to the plate 40. Since the magnet 60 has opposite poles at each of its upper and lower planar surfaces, the lines of flux extend axially therethrough, tending to hold the plate 30 in its closest position to the underlying ball race plate 40, which is the condition as shown in FIG. 4, with the minimum of air gap 63 therebetween. In this position there is also the minimum gap between the armature 28 and the pole 15, which corresponds to the energized or moved position of the solenoid.

The magnet 60 may be formed of any suitable permanently coercive material including Alnico V, ceramic, or samarium cobalt. The latter may be preferred by reason of its greater magnetic force, thus permitting a thinner or smaller magnet 60 to be used. Preferably a polytetrafluoroethylene (Teflon) sleeve 66 is supported on the inner diameters of the ball race plate 40 and magnet 60 and provides a second support or bearing surface for the armature 28. The sleeve 66 may be omitted where the side loading on the armature does not exceed that which may safely and easily be carried by the bearing 20. Where a coil bobbin is used, the sleeve 66 may be formed as an integral extension of one of the bobbin walls. A dust cover 68 may be used to enclose the rotating parts and to protect the magnet 60.

When the coil 13 is energized, a flux path is formed between the pole 15 and the armature 28, and to a lesser extent between the armature plate 30 and the case 10, which causes the armature plate 30 to roll on the ball bearings 44 to the position shown in FIG. 4. The flux from the magnet 60, when the coil 13 is energized, augments the flux through the case and armature formed by the coil, and thus augments the working force of the solenoid.

The current may now be removed from the coil 13 and the armature will be retained by the magnet in its moved position, that is the position shown in FIG. 4. When it is desired to release the armature to return to its initial or rest position, it is only necessary momentarily to provide a pulse of current of short duration to the coil 13 in the opposite sense, thereby temporarily cancelling the flux between the armature 28 and the pole 15. While the magnet-induced flux between the plate 30, through the bearings 44, the ball race plate 40 and the abutting wall 12 of the case will probably not be fully cancelled by a short reversal of current through the coil 13, nevertheless the cancelling of the flux across the armature and pole at the working faces thereof will be sufficient to release the armature to be returned to its rest position by the spring 50. Thus, in this regard, the magnet and a portion of the armature, together with the ball race plate 40 and case 10, provide a secondary flux path for the magnet 60, which prevents depolarization or demagnetization of the magnet 60 during the times that the current to the coil 20 may be reversed.

The invention has been described particularly as it relates to a rotary solenoid. However, the construction of parts employed in the making of a rotary solenoid advantageously lend themself to the design of a highly efficient cased type axial or push/pull solenoid, by removal of the ball races and the balls. The armature, when the coil is energized, will be strongly attracted to the pole, with some secondary attraction occurring through the armature plate and the case. Thus, the employment of an external permanent magnet between the armature plate and the case may efficiently and effectively provide for a trip type axial solenoid, and such an arrangement is illustrated in the cross-sectional view of FIG. 5, in which like parts are provided with like reference numerals, plus 100. Accordingly, the case 110 may be substantially identical to the case 10, in the axial embodiment of the invention. Likewise, the electric energizing coil 113 may be the same or substantially the same as the coil 13, and the base 114 with the inwardly directed pole 115 may again be the same or substantially the same as the corresponding parts of the rotary embodiment. The particular form of pole shown in FIG. 5 is that of a flat faced pole, but in such an axial solenoid, it is well within the ability of those skilled in the art to use conical pole faces or other pole configurations, as desired.

The coiled return spring 50 is not shown since it is not employed in this version. It will be understood that some external restoring spring, associated with the equipment to be operated by the solenoid, would normally be employed to return the armature to its starting position shown.

The push/pull version of the present solenoid will also employ an annular plate 140 which is superimposed on the outer surface of an axially oriented magnet 160. The plate 140 will differ from the plate 40 in that it may be made somewhat thinner, since it will not be coined to form ball races therein. In order, however, to establish a minimum working air gap, and to prevent metal-to-metal contact of the armature with the stator or pole, it is preferred to employ some form of a non-magnetic armature stop. In this instance, the stop may advantageously consist of a layer 141 of non-magnetic material, which may consist of a brass ring, or a ring of suitable plastic polymer, on the upper surface of the plate 140 which will come into contact with the armature plate 130 in the actuated position of the solenoid while still maintaining some slight air gap between the pole faces of the armature and pole. Thus, the dimensions of the working air gap 159 between the face of the pole 115 and the opposed face of the armature 128 is slightly greater than the air gap 163 between the plate 130 and the layer 141. Alternatively, a stop of non-magnetic material may be positioned on the face 129 of the armature or otherwise between the armature 128 and the pole 115.

Figure 5:
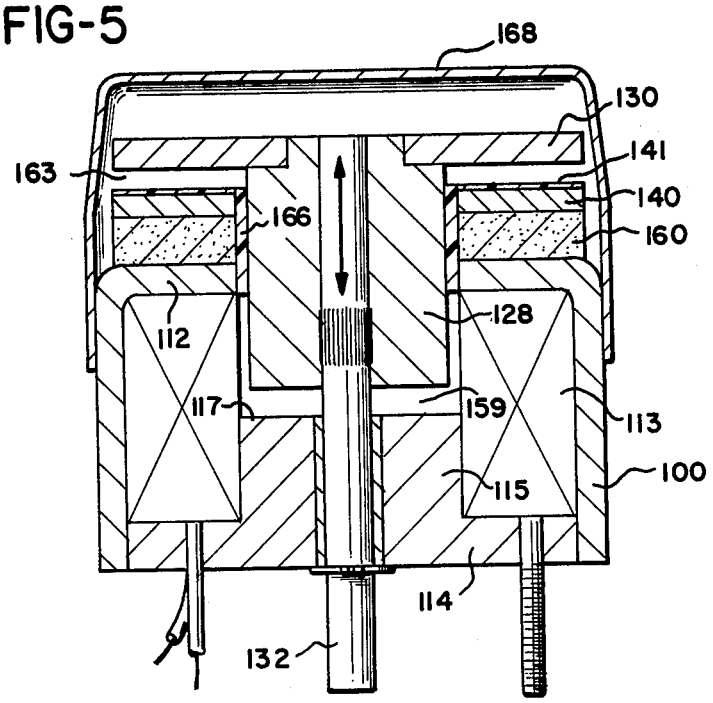
FIG. 5 is a sectional view of an axial trip solenoid according to my invention.

The operation of the embodiment of FIG. 5 is in accordance with the same principles as that previously described. The push/pull solenoid is shown in its unenergized position, and when the coil 113 is energized, the armature plate 130 will be drawn down against the spacer 141, with a major portion of the pull or attraction occurring across the air gap between the armature 128 and the pole 115. The external retraction spring or force, not shown, must of course be sufficient to retain the armature 128 in its unenergized position as shown when the power is removed from the coil. However, once energized, the magnet 160 will retain the armature in the moved position, against the restoring force of a return spring, until the coil 113 is pulsed in the opposite sense.

It will accordingly be seen that the invention provides a highly compact cased-typed solenoid actuator, both rotary and axial, including a magnet mounted exteriorly of the case and between the case and an armature plate.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A rotary solenoid actuator comprising:
a generally cup-shaped case,
an electric energizing coil received within said case,
a base received in said case and fixed thereto,
a central bore formed in said base for receiving an armature shaft,
means in the end of said cup defining an armature opening,
an armature received in said opening with a shaft thereon extending through said base opening for rotation with respect to said base,
a generally cylindrical plate attached for rotation with said armature exteriorly of said case and in spaced relation thereto,
means in said plate defining a plurality of arcuately extending axially inclined ball races,
an annular plate formed in underlying relation to said cylindrical plate and having means therein defining complementary inclined ball races for receiving a ball therebetween,
a ball in each of said complementary races, and
an annular thickness oriented magnet positioned between said annular plate and said case for forming a flux flow path through said case, axially through said base and armature and annular plate, providing a magnetic latch holding said solenoid armature in an actuated position in which said balls have rolled in said ball races to the deeper ends thereof.

2. A solenoid comprising:
a generally cup-shaped solenoid case,
an annular electric coil received in said case,
a base received in the open end of said case adjacent said coil and having means centrally thereof forming a solenoid pole,
means in the bottom of said case defining an armature-receiving opening,
an armature received in said case extending through said opening and having a pole face thereon normally spaced from said base pole,
a plate mounted on said armature exteriorly of said case and extending normal to the axis of rotation of said armature,
means in said plate defining three arcuately spaced and arcuately extending axially inclined ball races,
a permanent magnet positioned between said plate and said case,
means carried on said permanent magnet adjacent said plate defining three ball races complementary to the ball races on said plate for receiving a ball therebetween providing for rotary movement of said plate accompanied by axial movement of said armature,
spring means connected to rotate said armature in a direction to increase the air gap between said pole to a retracted position,
said magnet having sufficient magnetic force to maintain said armature in an energized position, against the restoring force of said spring means, when power is removed from said coil.

3. The rotary solenoid of claim 2 in which said means carried on said permanent magnet comprises:
an annular plate positioned between said permanent magnet and said armature plate.

4. The rotary solenoid of claim 3 in which said annular plate is adhesively bonded to said magnet and said magnet is adhesively bonded to said case.

5. The rotary solenoid of claim 2 in which said magnet is annular in shape.

6. A case type trip solenoid comprising:
a generally cup-shaped solenoid case,
an annular electric coil received in said case,
a base received in the open end of said case adjacent said coil and having means centrally thereof forming a solenoid pole,
means in the bottom of said case defining an armature-receiving opening,
an armature received in said case extending through said opening and having a pole face thereof normally spaced from said base pole,
a plate mounted on said armature exteriorly of said case and extending normal to the axis of movement of said armature, and
a permanent magnet positioned between said plate and said case,
means mounting said armature and plate for rotary movement on said case, and
ball race means between said magnet and said plate for converting axial to rotary movement.

* * * * *